US006285121B1

(12) United States Patent
Aono

(10) Patent No.: US 6,285,121 B1
(45) Date of Patent: Sep. 4, 2001

(54) FLAT IMAGE DISPLAY

(75) Inventor: Hiroshi Aono, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/341,734

(22) PCT Filed: Dec. 17, 1998

(86) PCT No.: PCT/JP98/05730

§ 371 Date: Jul. 15, 1999

§ 102(e) Date: Jul. 15, 1999

(87) PCT Pub. No.: WO99/34393

PCT Pub. Date: Aug. 7, 1999

(30) Foreign Application Priority Data

Dec. 26, 1997 (JP) ..... 9-360828

(51) Int. Cl.[7] ..... H01J 31/12

(52) U.S. Cl. ..... 313/422; 313/495; 313/456; 313/252

(58) Field of Search ..... 313/495, 422, 313/497, 482, 456, 252, 244, 269

(56) References Cited

U.S. PATENT DOCUMENTS

| | | | |
|---|---|---|---|
| 4,145,633 | 3/1979 | Peters | 313/422 |
| 4,900,981 | 2/1990 | Yamazaki | 313/422 |
| 4,982,134 | 1/1991 | Aono et al. | 313/456 |
| 5,256,937 | 10/1993 | Bubeck et al. | 313/495 |
| 5,504,387 | 4/1996 | Hamagishi | 313/310 |

FOREIGN PATENT DOCUMENTS

| | | |
|---|---|---|
| 0 391 140 | 10/1990 | (EP) . |
| 0 498 379 | 8/1992 | (EP) . |
| 0 646 946 | 4/1995 | (EP) . |
| 0 739 029 | 10/1996 | (EP) . |
| 62-29046 | 2/1987 | (JP) . |
| 2-288052 | 11/1990 | (JP) . |
| 3-67444 | 3/1991 | (JP) . |
| 4-249048 | 9/1992 | (JP) . |
| 96/30926 | 10/1996 | (WO) . |
| 97/15912 | 5/1997 | (WO) . |

*Primary Examiner*—Ashok Patel
(74) *Attorney, Agent, or Firm*—Merchant & Gould P.C.

(57) ABSTRACT

A plurality of fixing stands (32) are attached to the inner face of a rear case (10), and a back electrode substrate (33) that functions as a back electrode and an electrode unit (11) formed by superposing a plurality of electrode plates via insulators are attached to the fixing stands (32). In this case, only one fixing stand positioned substantially at the center of the back electrode substrate (33) in the plurality of fixing stands (32) is fixed to the back electrode substrate (33), and presser bar plate springs (36) for pressing the substrate are attached onto the remaining fixing stands to fix the back electrode substrate (33) by their elasticity. Such an attachment structure enables thermal distortion in fabrication processes and during operation and influences of vibration/impacts from the exterior to be absorbed or eliminated, thus providing a flat-type image display apparatus with high accuracy and high image quality.

16 Claims, 10 Drawing Sheets

FLAT IMAGE DISPLAY

TECHNICAL FIELD

The present invention relates to a flat-type image display apparatus used for a television receiver, a computer-terminal display unit, or the like.

BACKGROUND ART

Recently, the development for reducing the thickness of color image display apparatus has been carried out actively. Particularly, for example, Publication of Unexamined Japanese Patent Application (Tokkai-Hei) No. 3-67444 proposes a flat-type image display apparatus employing a beam scanning method in which the distance from a cathode to an anode is shortened significantly compared with a conventional cathode-ray tube (CRT) system. In the flat-type image display apparatus, a screen is divided into a plurality of sections vertically. An electron beam is deflected vertically to display a plurality of lines on each section. Further, the screen is also divided into a plurality of sections horizontally. In each section, phosphors of R, G, and B emit light sequentially. An amount of electron beams irradiated onto the phosphors of R, G, and B is controlled by the received color picture signals. Thus, a television picture is displayed as a whole.

In the above-mentioned flat-type image display apparatus, an electrode unit in which the distance from a cathode to an anode is shortened significantly and linear hot cathodes (hereafter referred to as "linear cathodes") as electron beam sources are housed in a flat-box type vacuum case. Electrodes forming the electrode unit are provided with small holes or slits for deflecting, focusing, and controlling electron beams emitted from the linear cathodes. The electron beams go through the electrodes while being controlled by the holes or slits in each electrode and accelerated to the anode to cause light emission of phosphors applied to the anode, thus displaying images.

FIG. 7 is an exploded perspective view showing the internal structure of a flat-type image display apparatus. In the flat-type image display apparatus, a back electrode 1, linear cathodes 2 (in the figure, only four linear cathodes are shown) extending horizontally, an electron beam extracting electrode 3, a signal electrode 4, focusing electrodes 5 and 6, a horizontal deflection electrode 7, and a vertical deflection electrode 8 are arranged sequentially. These sheet-like electrodes 3–8 are superposed via insulators and spacers, thus forming an electrode unit 11. The electron beam extracting electrode 3 is provided with electron beam extracting holes 12. Electron beams 13 emitted from the linear cathodes 2 are extracted through the holes 12 so as to form an apparent one electron beam per hole. An extracted electron beam 13 is controlled, focused, and deflected by the respective electrodes 4–8 to scan a subsection 14 on the anode screen.

The phosphors of R, G, and B are printed and applied onto screen sections, for example, 14–16 in the inner side of a front case 9 that is a flat-box type front glass case. Further, a metal-backed layer is formed on the sections 14–16 to apply high voltage. The electron beams are accelerated to have high energy and strike the metal-backed layer, thus exciting the phosphors so that the phosphors emit light. The electron beam 13 allows the subsection 14 of the screen to emit light to display a part of an image. Similarly, other electron beams cause light emission of all the other subsections, such as the subsection 16, to display images. Thus, a desired image is displayed on the whole screen. A rear case 10 and the front case 9 are combined and sealed, and then a vacuum is drawn on its inside, thus forming a flat-type image display apparatus.

FIG. 8 is a perspective view showing the appearance of a sealed flat-type image display apparatus. The front case 9 and the rear case 10 are baked to be sealed with low melting point glass. Numeral 17 indicates an exhaust pipe for drawing the vacuum inside the case, numeral 18 a high-voltage terminal of the anode, and numeral 19 outgoing terminals for controlling various electrodes forming the electrode unit. By connecting a driving circuit, a signal processing circuit, or the like to these terminals externally, the flat-type image display apparatus functions as a television receiver or a display unit.

Internal components constructing the aforementioned flat-type image display apparatus are exposed to high temperature repeatedly in a sealing step in the assembly and fabrication process and during operation of the apparatus as an image display apparatus. In other words, in the assembly and fabrication process, the apparatus is exposed to a high temperature of about 500° C. both in fixing a plurality of fixing stands for attaching various electrodes to the glass rear case using low melting point glass and in combining and baking the front case and the rear case to seal the case using low melting point glass at a peripheral adhering portion of the case. Further, for example, a process of drawing high vacuum inside the glass case after sealing the glass case is carried out in a heating furnace at about 300–350° C. Thus, the apparatus is heated repeatedly. During the operation of the apparatus as an image display apparatus, a number of linear cathodes stretched in a plane are heated to a high temperature of 600–700° C. for generating electron beams. Due to such heat radiation, the various internal electrodes also are exposed to high temperature.

In order that a proper beam spot scans precisely the screen surface on which phosphors have been printed to avoid deviation of beam position on the screen so as to display vivid images with high precision even if the apparatus is exposed to high temperature in the aforementioned assembly and fabrication process and during the operation, the apparatus must have accuracy on a micron level and the accuracy must be maintained. However, generally objects exposed to high temperature repeatedly are subjected to thermal deformation such as expansion and contraction repeatedly due to the temperature change. Therefore, in order to allow the repeated exposure to high temperature and the maintaining of high accuracy to be compatible, problems of physically incompatible occurrences must be solved.

Particularly, while a flat-type image display apparatus has a flat shape, it is necessary to form the apparatus so as to have a glass-plate-like case body with a front case and a rear case, both of which are thick to have a thickness of about 10 mm, to obtain a resist pressure of the outside air by drawing high vacuum inside the case, thus causing extremely high thermal stress in the above-mentioned assembly process at high temperature.

The problems to be solved in a conventional example will be explained with reference to FIGS. 9 and 10 as follows.

FIG. 9 is a plan view showing an example of the arrangement of electrode support plates and electrode fixing plates for fixing an electrode unit including various electrodes that is attached to the inner face of a rear case of a conventional flat-type image displaying apparatus. In addition, FIG. 9 schematically shows a state in which thermal expansion and distortion occur in the above-mentioned heating processes.

FIG. 10 is a partial cross-sectional view showing a schematic structure of the flat-type image display apparatus shown in FIG. 9 in which the electrode unit is attached by fixing the electrode support plates and the electrode fixing plates that are assembled in a parallel-crosses form to fixing stands.

In FIG. 9, arrows A, B, C, . . . , P show thermal stress lines seen in a plane, and an alternate long and short dash line shows a slightly exaggerated distortion condition in which a rear case 10, electrode support plates 20, and electrode fixing plates 21 have been expanded and deformed due to the thermal effect as a result of the thermal stress.

Fixing stands 22 for fixing the electrode support plates 20 and the like to the rear case 10 are displaced according to the expansion and contraction of the glass-plate like rear case 10, which is not shown in the figure. The same is applied to the electrode unit to be fixed onto these electrode support devices.

The expansion caused by heating and the contraction caused by cooling may not be problems when all the components that are combined inside the case have the same coefficient of thermal expansion. However, in the conventional example, the case is made of glass, the electrode support plates 20 and the electrode fixing plates 21 are formed of a 50 Ni—Fe material, and a plurality of electrode plates forming an electrode unit 11 are made of an alloy (for instance, a 36 Ni—Fe alloy) having a low coefficient of thermal expansion. Therefore, the difference in coefficient of thermal expansion among those components causes the difference in distortion due to the thermal deformation. Consequently, cracks and warps occur at weak spots and stress concentration spots, which have been a problem.

FIG. 9 shows that the rear case 10 expands by being heated to the position shown with the alternate long and short dash line indicated with 10'. In this case, fixing stands 22*a*~22*f* tend to be displaced in the same way. An electrode unit (not shown in the figure) is fixed onto the fixing stands 22*a*~22*d* indirectly with fixing screws 23*a*–23*d* respectively. On the other hand, the electrode plates forming this electrode unit serve to control and supply focused electron beams and the electron beams must accurately strike R, G, and B phosphors that have been printed on the inner face of a front case 9 minutely. Therefore, when the screen and the electrodes are thermally displaced differently, basic performance as an image display apparatus cannot be obtained.

The electrode unit 11 made of a 36 Ni—Fe alloy is fastened and fixed to the electrode support plates 20 to form one component with screws 24*a*–24*d* for mounting the electrode unit in FIG. 9. The volume of deformation of the electrode unit itself is controlled to be small by employing an alloy that is not thermally deformed much. On the contrary, the electrode support plates 20 and the electrode fixing plates 21 are made of a 50 Ni—Fe alloy as mentioned above and thus have a coefficient of thermal expansion similar to that of glass. Therefore, the electrode support plates 20, the electrode fixing plates 21, and the rear case 10 are thermally deformed prior to the change of the electrode unit 11.

In addition, the thermal deformation caused by the difference in accuracy depending on the dimensional accuracy and assembly accuracy of the electrode support plates 20 and the electrode fixing plates 21 also must be considered.

In short, the intersection points of the electrode support plates 20 and the electrode fixing plates 21 that are assembled in a parallel-crosses form are fixed to the electrode unit made of a 36 Ni—Fe alloy using the screws 24*a*–24*d* for mounting the electrode unit so as to form one component. Therefore, the electrode support plates 20 and the electrode fixing plates 21 cannot be displaced at their intersection points and thus are displaced at their intermediate points in respective directions indicated with the arrows A, B, C, and D in a curved manner. Thus, the fixing stands 22*e* and 22*f* at the intermediate points are affected most and are the parts where cracks or the like occur easily.

FIG. 10 shows an example of such a state. The difference in displacement magnitude between the arrow S showing the thermal displacement direction of the electrode fixing plates 21 and the arrow R showing the thermal displacement direction of the rear case 10 leads to breakage and causes unwanted occurrence such as cracks 31 and the like in a low melting point glass 30, which has been a problem. In addition, such occurrence is not uniform, which also has been a problem.

When an external force such as vibration, impact from falling, or the like is applied, as shown in FIG. 10, the electrode support plates 20 serve as points of support since the electrode unit 11 contacts with and is supported by the electrode support plates 20 at both ends of the electrode unit 11. Thus, the electrode unit 11 resonates at a proper frequency to have the greatest amplitude in the vicinity of the central portion. In the worst case, the electrode unit 11 and linear cathodes 2 come into contact with each other and carbonates that have been applied to the linear cathodes 2 fall, which has been a problem.

For a plurality of linear cathodes, the electric fields at the central portion of the case and in the vicinities of the electrode support plates 20 are not uniform. Therefore, the difference in electron-beam emission capacity among the linear cathodes occurs and thus disturbs the uniformity in an image, which has been a problem.

Furthermore, in spattering a getter that adsorbs gases in a vacuum, the spattered getter adheres onto the linear cathodes and the outgoing terminals, thus causing bad insulation, which has been a problem.

DISCLOSURE OF THE INVENTION

The present invention solves the problems of the above-mentioned conventional flat-type image display apparatus. It is an object of the present invention to provide a flat-type image display apparatus that can realize and maintain desired assembly accuracy by absorbing thermal distortion caused by high exposure temperature in fabrication processes and during operation and is not affected much by vibration/impacts caused by external factors.

It also is an object of the present invention to provide a flat-type image display apparatus that provides uniform images by canceling the difference in electron-beam emission capacity among linear cathodes.

Further, it is another object of the present invention to provide a flat-type image display apparatus in which bad insulation caused by the adhesion of spattered getter does not occur.

In order to attain the above-mentioned objects, a flat-type image display apparatus of the present invention comprises a flat-type screen to which phosphors have been applied, a plurality of stretched linear cathodes, an electrode unit including a plurality of sheet-like electrode plates, and a back electrode made of a conductive material that are arranged in a case formed of a front case and a rear case, and the case is sealed with its inside being under a vacuum. The flat-type image display apparatus of the present invention is characterized by the following structure. A fixing stand is attached to an inner face of the rear case; a back electrode substrate that functions as the back electrode is attached onto the fixing stand; the electrode unit is mounted on the upper face of the back electrode substrate; and the attachment structure of the back electrode substrate and the mounting structure of the electrode unit have at least one of systems for absorbing thermal distortion and for preventing vibration/impacts.

A flat-type image display apparatus of the present invention comprises a flat-type screen to which phosphors have been applied, a plurality of stretched linear cathodes, an electrode unit including a plurality of sheet-like electrode plates, and a back electrode made of a conductive material that are arranged inside a case formed of a front case and a rear case, and the case is sealed with its inside being under a vacuum. The flat-type image display apparatus of the present invention is characterized by the following structure. A plurality of fixing stands are attached to an inner face of the rear case; a back electrode substrate that functions as the back electrode is attached onto the fixing stands; the electrode unit is mounted on the upper face of the back electrode substrate; only one fixing stand positioned substantially at the center of the back electrode substrate in the plurality of fixing stands is fixed to the back electrode substrate; and presser bar plate springs are attached onto the fixing stands except the fixing stand positioned substantially at the center of the back electrode substrate so as to fix the back electrode substrate by the elasticity of the presser bar plate springs.

In the present invention, the distortion caused by the heat to the electrode unit from other components and impacts or the like from the exterior can be absorbed by contriving the structure of retaining the back electrode substrate with elasticity as described above and preferably a method of attaching electrode fixing platforms. In other words, the present invention can provide a flat-type image display apparatus with high accuracy and high image quality that can realize and maintain desired assembly accuracy by absorbing the thermal distortion caused by the high exposure temperature in fabrication processes and during operation and is not affected much by vibration/impacts caused by external factors.

By maintaining the electrode unit with the pressure of the back electrode caused by vacuum deformation of the rear case, the influence on the electrode unit in thermal processes is eliminated, and further when the electrode unit resonates due to external forces such as vibration, impact from falling, or the like, its amplitude is held down, thus preventing the contact with the linear cathodes.

In addition, screen-like back electrode plates are arranged in parallel to the plurality of linear cathodes. By applying suitable voltage to the back electrode plates, the electric fields in the vicinities of the respective linear cathodes become uniform and the difference in electron-beam emission capacity among the linear cathodes is cancelled. Thus, uniform images without unevenness in luminance can be obtained.

Moreover, by placing a getter in the space between the rear case and the back electrode substrate whose peripheral portion is bent in a flange shape, spattered getter is stopped by the back electrode substrate and the flange portion and therefore does not adhere onto the linear cathodes and the outgoing terminals, thus preventing bad insulation.

BEST MODE FOR CARRYING OUT THE INVENTION

Figure 1:
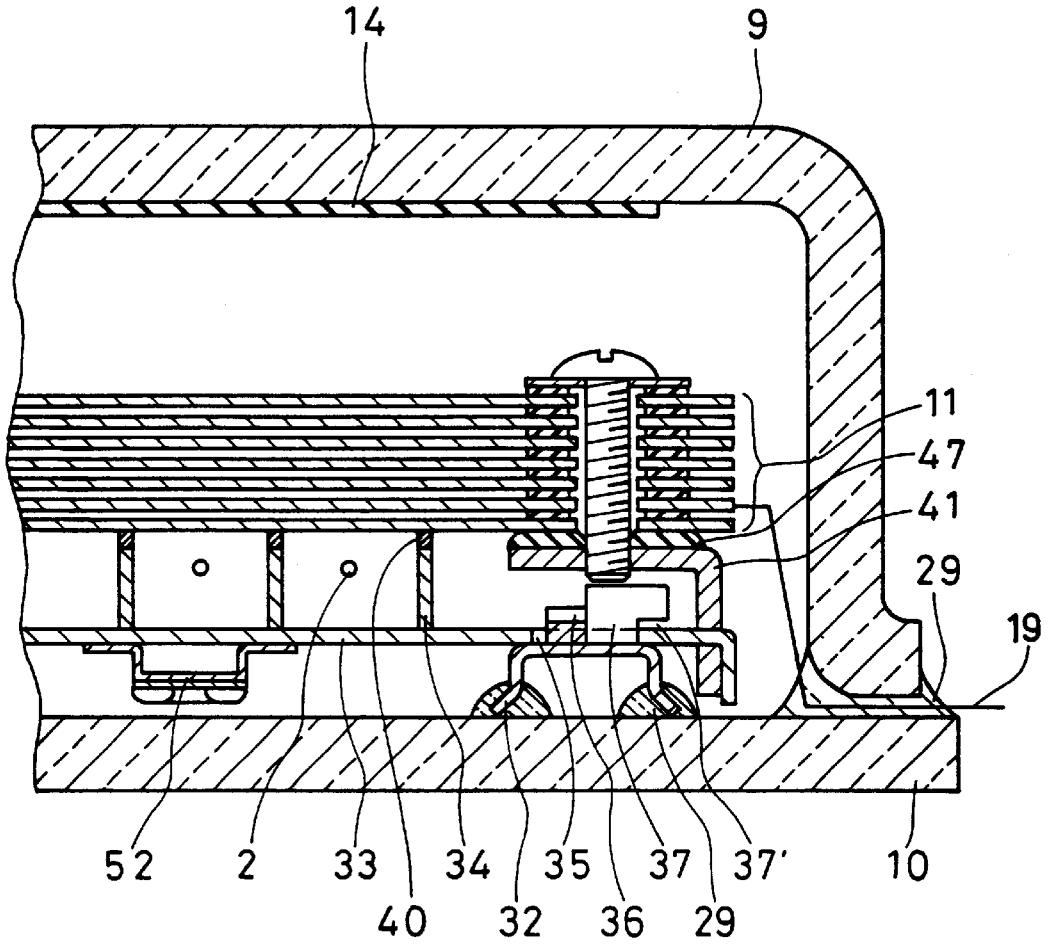
FIG. 1 is a partially enlarged cross-sectional view showing the structure of a corner portion in an electrode support device of the present invention.

An embodiment of the present invention will be explained with reference to the drawings as follows. In the present specification, the same parts are indicated with the same reference characters for easy understanding as long as there is no inconvenience.

Figure 2:
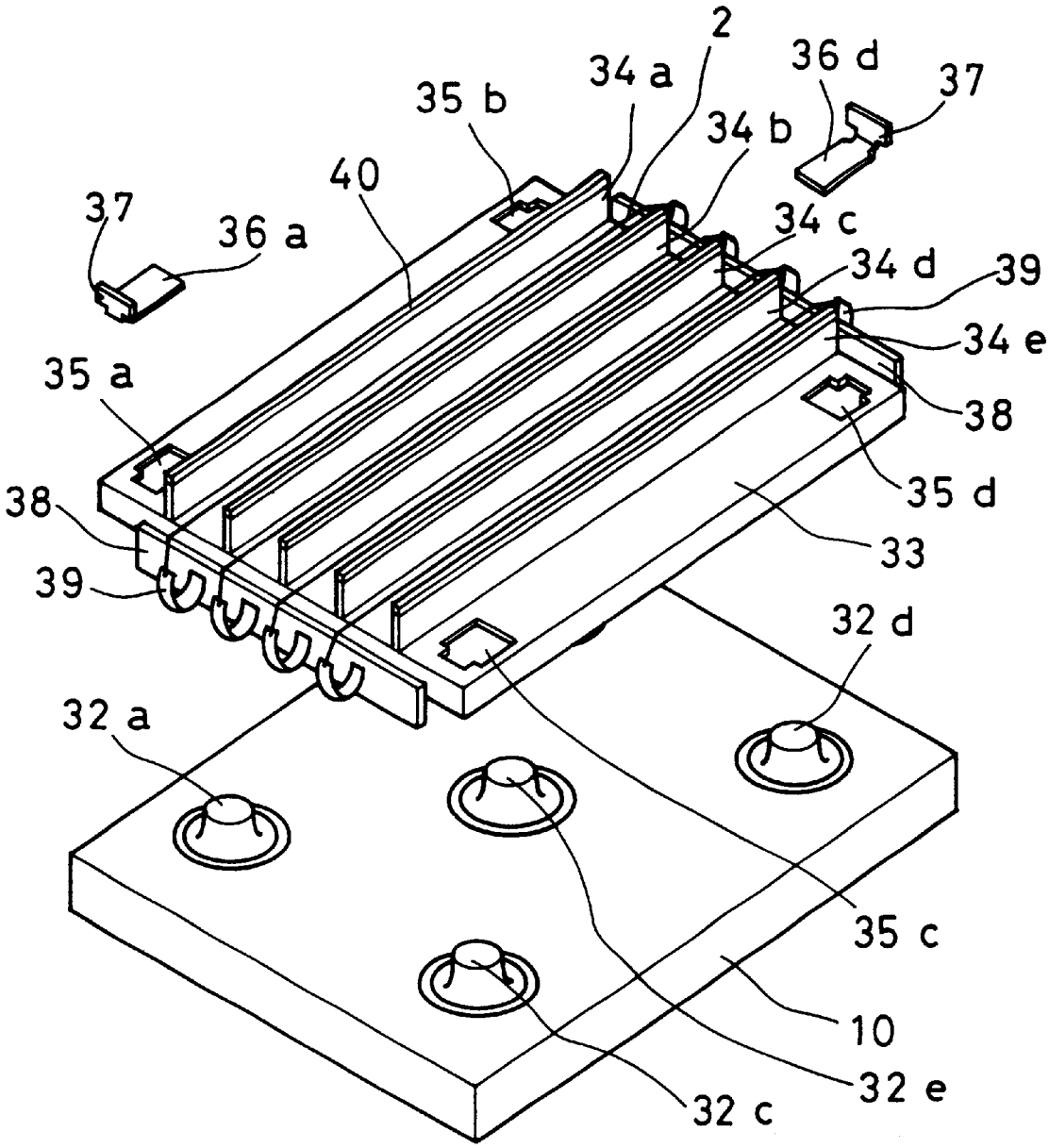
FIG. 2 is an exploded perspective view showing an example of the schematic assembly structure of the electrode support device in a flat-type image display apparatus of the present invention.
Figure 3:
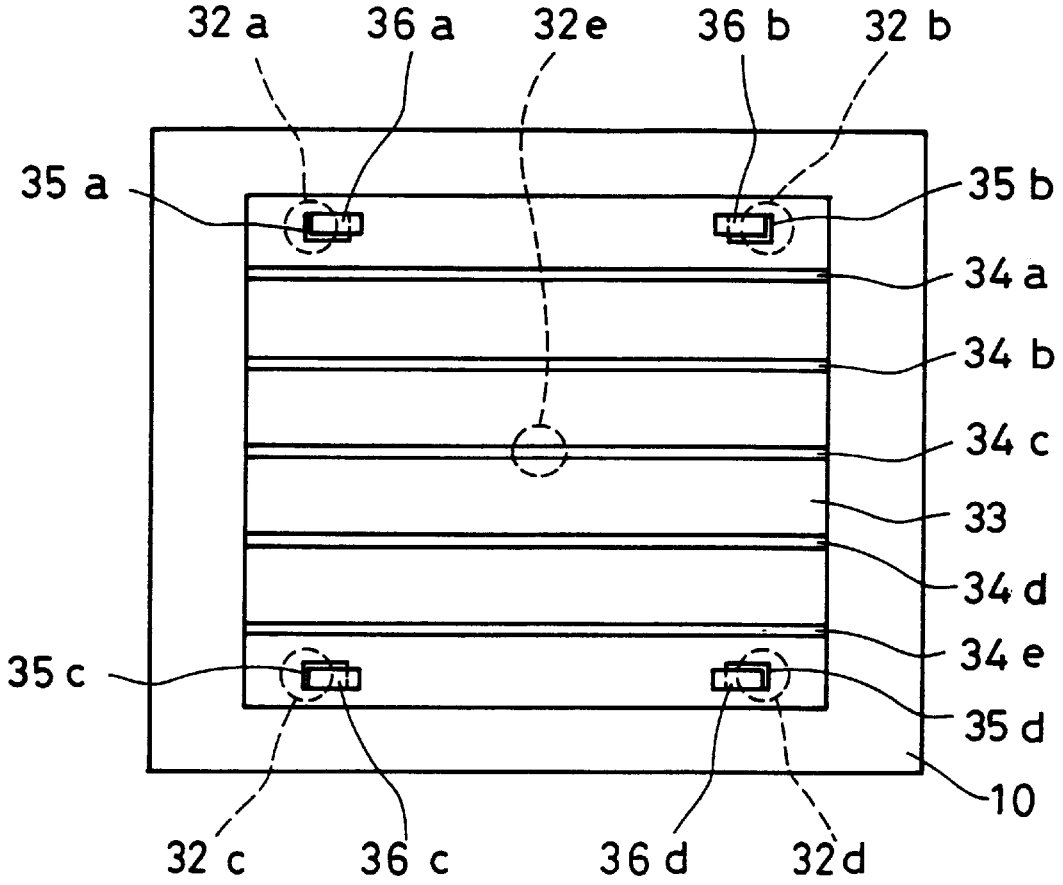
FIG. 3 is a schematic plan view of the electrode support device in FIG. 2.

FIG. 2 is an exploded perspective view showing an example of the schematic assembly structure of an electrode support device in a flat-type image display apparatus of the present invention. FIG. 3 is a schematic plan view of the electrode support device in FIG. 2.

As shown in FIGS. 2 and 3, a plurality of back electrode plates 34*a*–34*e* are equally spaced in a screen-like manner on a back electrode substrate 33 that functions as a back electrode. At predetermined positions of four corners, slits 35*a*–35*d* are formed. On the other hand, a plurality of metal fixing stands 32*a*–32*e* that are baked and fixed with low melting point glass are formed on the inner face of a rear case 10. The positions of the fixing stands 32*a*–32*d* except the fixing stand 32*e* at the center correspond to the positions of the slits 35*a*–35*d* in the back electrode substrate 33 respectively.

The substrate 33 is mounted on the fixing stands 32*a*–32*e* on the rear case 10 as shown in FIG. 3. The fixing stand 32*e* at the center and the central portion of the substrate 33 are fixed by welding. Presser bar plate springs 36*a*–36*d* for pressing the substrate are fixed to the remaining fixing stands 32*a*–32*d* by welding. The substrate 33 is fixed while being pressed against the fixing stands due to the elasticity of the springs with the substrate 33 being sandwiched between the fixing stands and the springs at respective slits in the substrate 33. In FIG. 2, the springs 36*b* and 36*c* were omitted.

More specifically, after the respective springs 36*a*–36*d* are inserted into recessed portions of the slits 35*a*–35*d* at corners of the substrate 33 so as to fit therein, the bottom faces of the springs are brought into contact with the upper faces of the fixing stands 32*a*–32*d* that have been fixed to the rear case 10. Then, the springs 36*a*–36*d* and the upper faces of the fixing stands 32*a*–32*d* are fixed by welding.

As described above, in the flat-type image display apparatus of the present invention, the central portion of the substrate 33 and the fixing stand 32*e* are fixed directly by welding, and the slits at the corners are not fixed to the corresponding fixing stands 32*a*–32*d* directly but the springs 36*a*–36*d* press and retain the substrate 33, thus fixing respective fixing stands 32*a*–32*e* and the back electrode substrate 33.

FIG. 1 is a cross-sectional view showing the structure of a corner portion of an electrode support device of the present invention. FIG. 1 is a detail view showing electrode supporting structure, particularly the structure in which a back electrode substrate 33 is pressed and retained by a fixing stand 32 (32*a*–32*d*) and a presser bar plate spring 36 (36*a*–36*d*) for pressing the substrate.

As shown in FIG. 1, the spring 36 is inserted into a slit 35 in the substrate 33, and the spring 36 and the upper face of the fixing stand 32 are brought into contact and then are fixed by welding. The spring 36 is shown partially in a cross-sectional view.

Further, as shown in FIGS. 1 and 2, a rising bent pawl 37 is provided on the end face in the outer side in the axial direction of the spring 36 so as to form one component with the spring 36. The pawl 37 is wider than the slit 35 and has a height with some tolerance for the plate thickness at the slit portion in the substrate 33. The pawl 37 is designed so as to cover the upper face of the substrate 33 with a small space 37' when the spring 36 is inserted into the slit in the substrate 33 and is fixed to the fixing stand 32 by welding. This structure is employed so that the retention with the elasticity by the spring 36 takes precedence.

This pawl 37 is not designed for pressing down and fixing the substrate 33 but for serving as a pressure pawl for preventing the lift-off distortion caused by the thermal processes in the fabrication processes of the flat-type image display apparatus according to the present invention and the lift-off displacement of the electrode support device due to any external factors of vibration, impact, or the like after completion of the apparatus.

It is important that the spring 36 has a size that allows the spring 36 to be inserted into and fit inside the slit 35 in the substrate 33 with sufficient allowance both in length and width. This allowance serves for absorbing metrication error of components and the thermal deformation caused by the difference in coefficient of thermal expansion among the components.

The quality of the metallic material forming the electrode support device that is assembled in a screen-like manner is also comprehensively important for solving the problems described in the foregoing section. If possible, it is preferable that the metallic material has comparable thermal characteristics to those of glass forming a front case 9 and the rear case 10. In a conventional example, it was difficult to deal with the complex thermal change caused by the use of dissimilar metals such as a 36 Ni—Fe alloy used for the electrode plates and a 50 Ni—Fe alloy used for the electrode support plates/electrode fixing plates as described above in addition to the combination of the thick glass plates and the thin metal sheets. On the contrary, in the present invention, in order to solve the problems in the conventional example, it is preferred to use a material with the same quality as that of the material used for the electrode plates for both the back electrode substrate 33 and the back electrode plates 34 (34*a*–34*e*) forming the electrode support device. However, since the difference in thermal expansion due to the different materials can be absorbed by the elasticity of the spring 36 fixed to the fixing stand 32 by welding as described above, even iron is well applicable in considering the costs.

Figure 4:
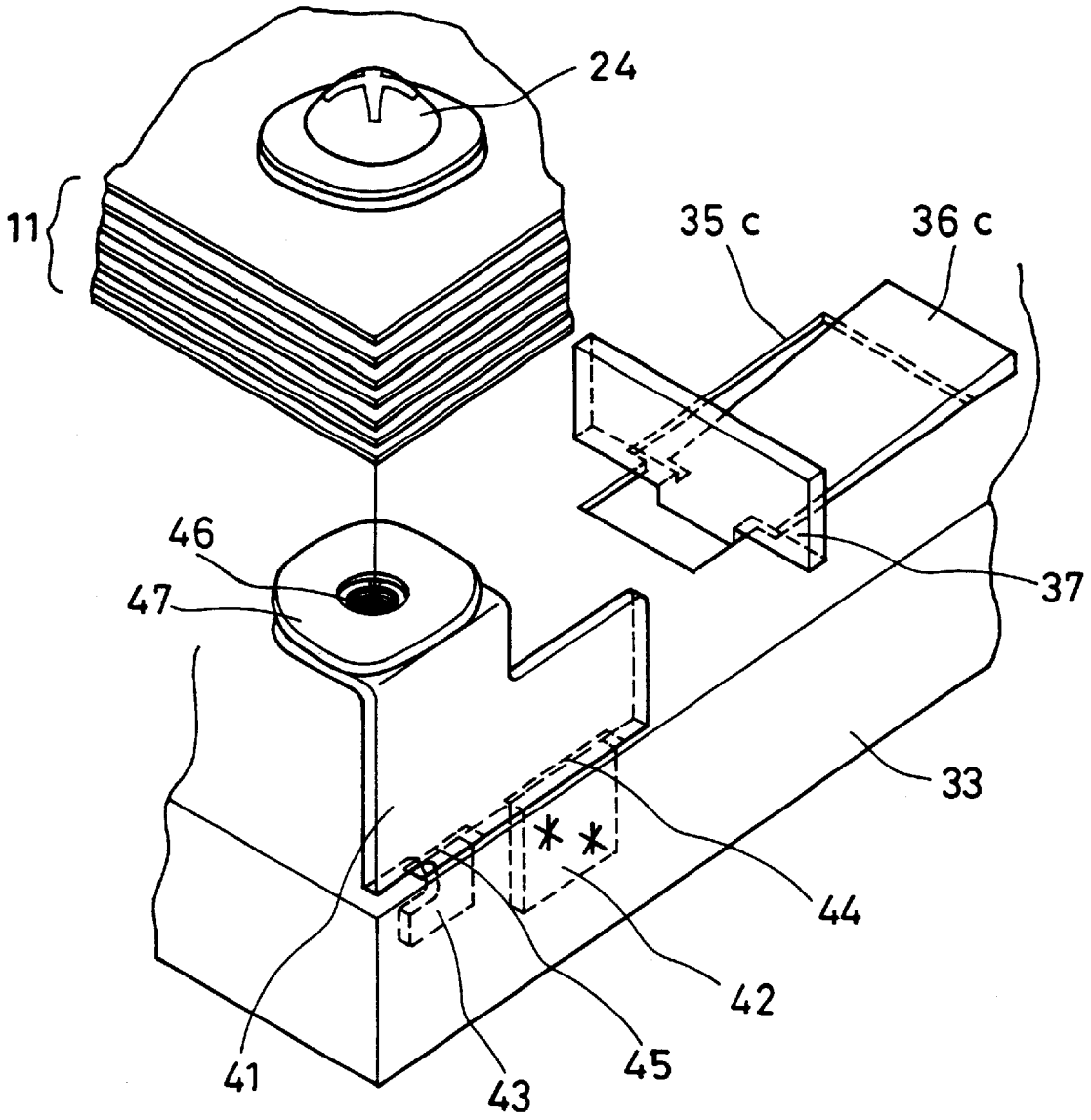
FIG. 4 is a schematic perspective view showing the structure in which a back electrode substrate and an electrode unit are fixed in the present invention.

FIG. 4 is a schematic perspective view showing the structure in which the back electrode substrate and the electrode unit are fixed. A method of fixing the electrode unit using electrode fixing platforms will be explained with reference to FIG. 4.

An electrode fixing platform 41 is positioned at a corner (four corners) of the back electrode substrate 33. A fixed part 42 and a stopper 43 of the platform 41 are inserted into a slit 44 for the fixed part and a slit 45 for the stopper respectively that are provided in the substrate 33. The flange-shaped bent portion in the substrate 33 and only the fixed portion 42 of the platform 41 are fixed by welding.

The electrode unit 11 is fastened and fixed with a screw 24 for mounting the electrode unit at a screw hole 46 provided in the platform 41 via an insulating film 47 placed around the screw hole 46. In this case, the height of the insulating film 47 placed on the platform 41 is set suitably to be lower than that of the insulators 40 (see FIGS. 1 and 2) on the upper faces of the back electrode plates 34, so that the lower face of the electrode unit is pressed against the upper face of the plates 34 when the electrode unit 11 is fastened and fixed (see FIG. 1). Thus, the stress caused by the deformation of the rear case 10 in drawing a vacuum, which will be described later, can be transmitted to the electrode unit 11, thus improving the accuracy in the superposition direction of the electrode unit 11.

Further, the platform 41 is fixed by welding only at the fixed part 42 at one end. The stopper 43 at the other end is set to be free. Thus, the difference in thermal expansion between the substrate 33 and the electrode unit 11 is absorbed by making use of the flexibility of the platform 41, and at the same time when impact caused by falling or the like is applied, the stopper 43 is pressed against the substrate 33, thus preventing the deformation of the electrode unit 11.

In the above, mainly the method for dealing with the displacement in the horizontal plane parallel to a screen of the flat-type image display apparatus during the thermal processes was explained. Further, an electrode support device as a system for solving the problem of vertical displacement during the thermal processes will be explained with reference to FIG. 5.

Figure 5:
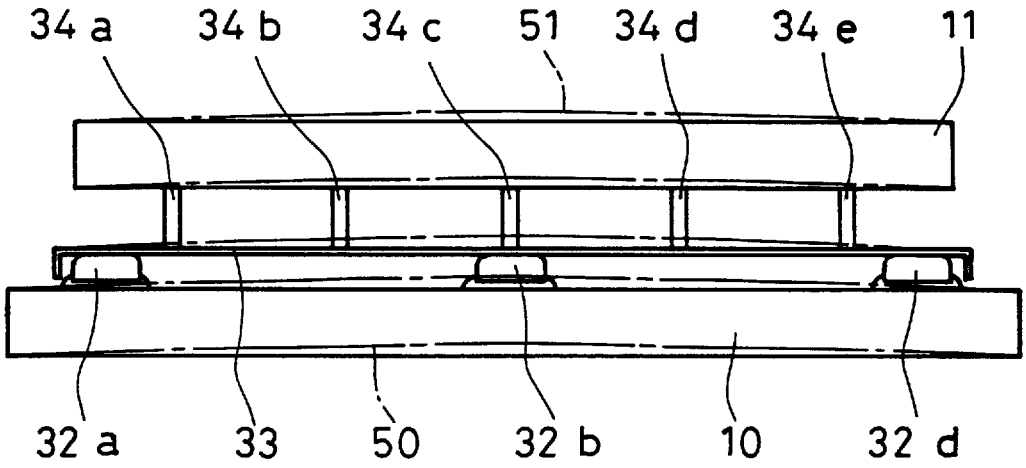
FIG. 5 is a cross-sectional view schematically showing a side face of the electrode support device according to the present invention.

FIG. 5 is a cross-sectional view schematically showing a side face of the electrode support device of the present invention. The back electrode substrate 33 on which the back electrode plates 34*a*–34*e* are assembled in a screen-like manner is mounted on the upper faces of the fixing stands 32*a*–32*e* that are positioned on the rear case 10 by being fixed with low melting point glass. The substrate 33 and the fixing stands are fixed by welding directly and indirectly by the method described in the above with reference to FIGS. 1 and 2. Further, the electrode unit 11 is placed on the back electrode plates 34 forming a screen-like supporting frame, and as described with reference to FIG. 4, the electrode unit 11 and electrode fixing platforms (not shown in the figure) provided at corners of the substrate 33 are fixed with screws.

In the process of sealing the glass case and drawing a vacuum on its inside during the thermal process, the rear case 10 is deformed as shown with an alternate long and short dash line 50 in FIG. 5 due to the attraction pulling the rear case 10 inward. By applying this deformation to the electrode unit positively to increase the pressing force between the electrode unit 11 and the back electrode plates 34, the deformation of the electrode unit 11 due to external forces such as vibration, impact from falling, or the like can be prevented. Further, regardless of the accuracy in flatness of respective single components in the electrode unit 11, the assembly accuracy in flatness depends on the volume of vacuum deformation of the substrate 33 forming the screen-like supporting frame and the rear case 10. Therefore, the yield of the accuracy in flatness of respective single components in the electrode unit 11 can be improved.

When the plurality of back electrode plates 34 are formed to have a shape substantially of an upward convex curve so that their central portions are higher than their peripheral portions respectively, the accuracy of the electrode unit is further improved.

Figure 8:
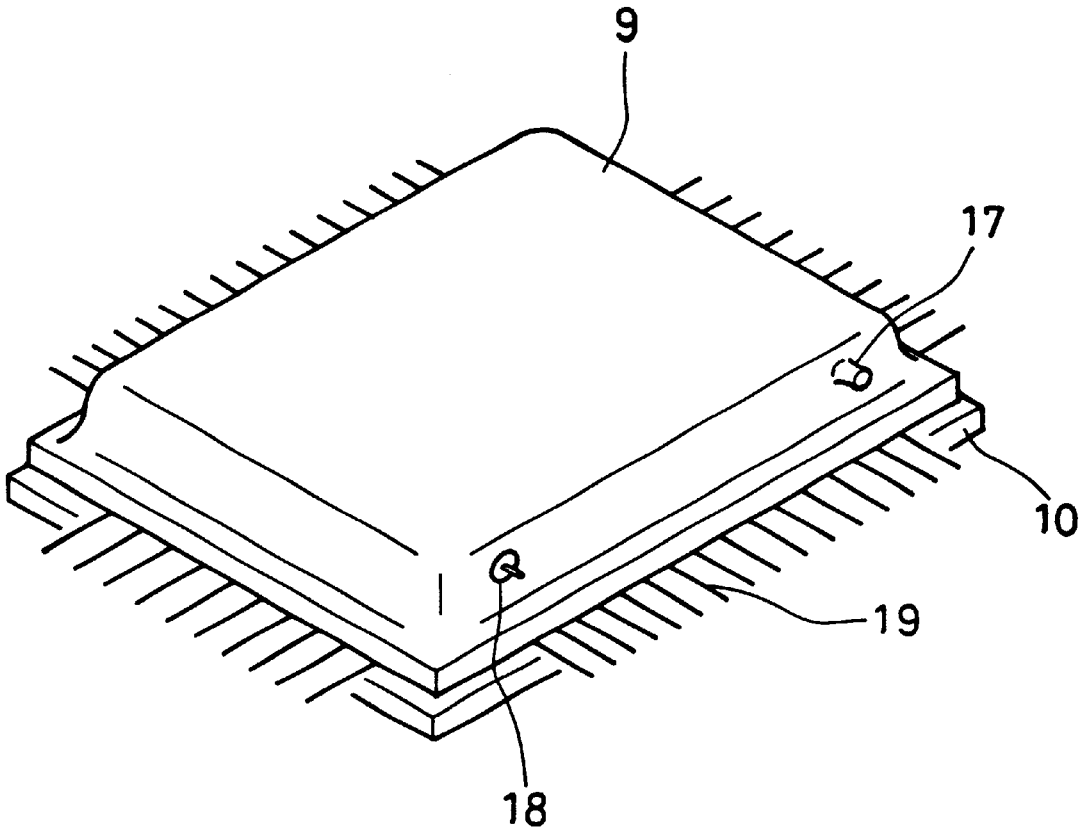
FIG. 8 is a perspective view showing the appearance of a flat-type image display apparatus.
Figure 9:
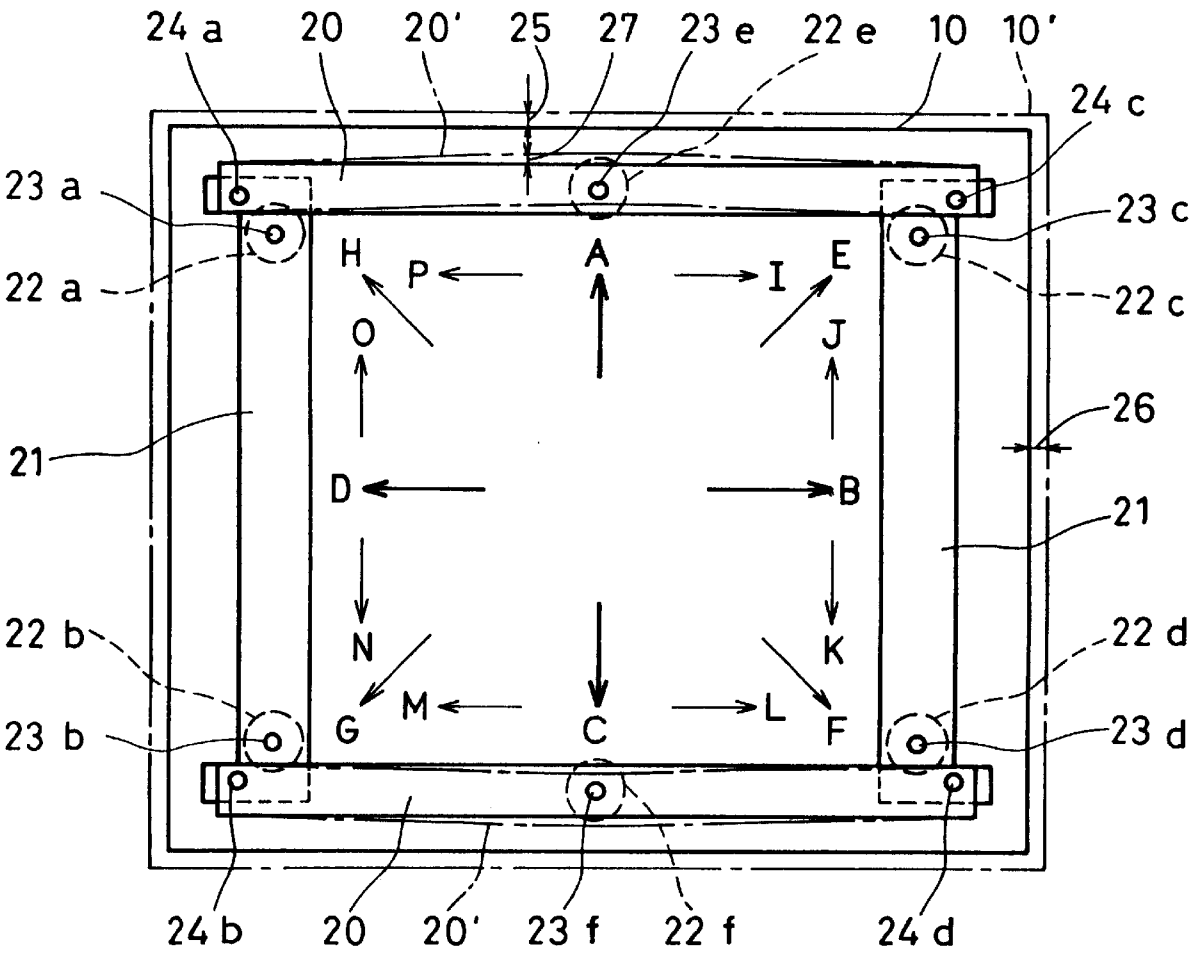
FIG. 9 is a plan view showing an example of the arrangement of electrode support plates and electrode fixing plates that are attached to the inner face of a rear case of a conventional flat-type image display device and illustrating the state of thermal expansion/thermal distortion due to thermal processes schematically.
Figure 10:
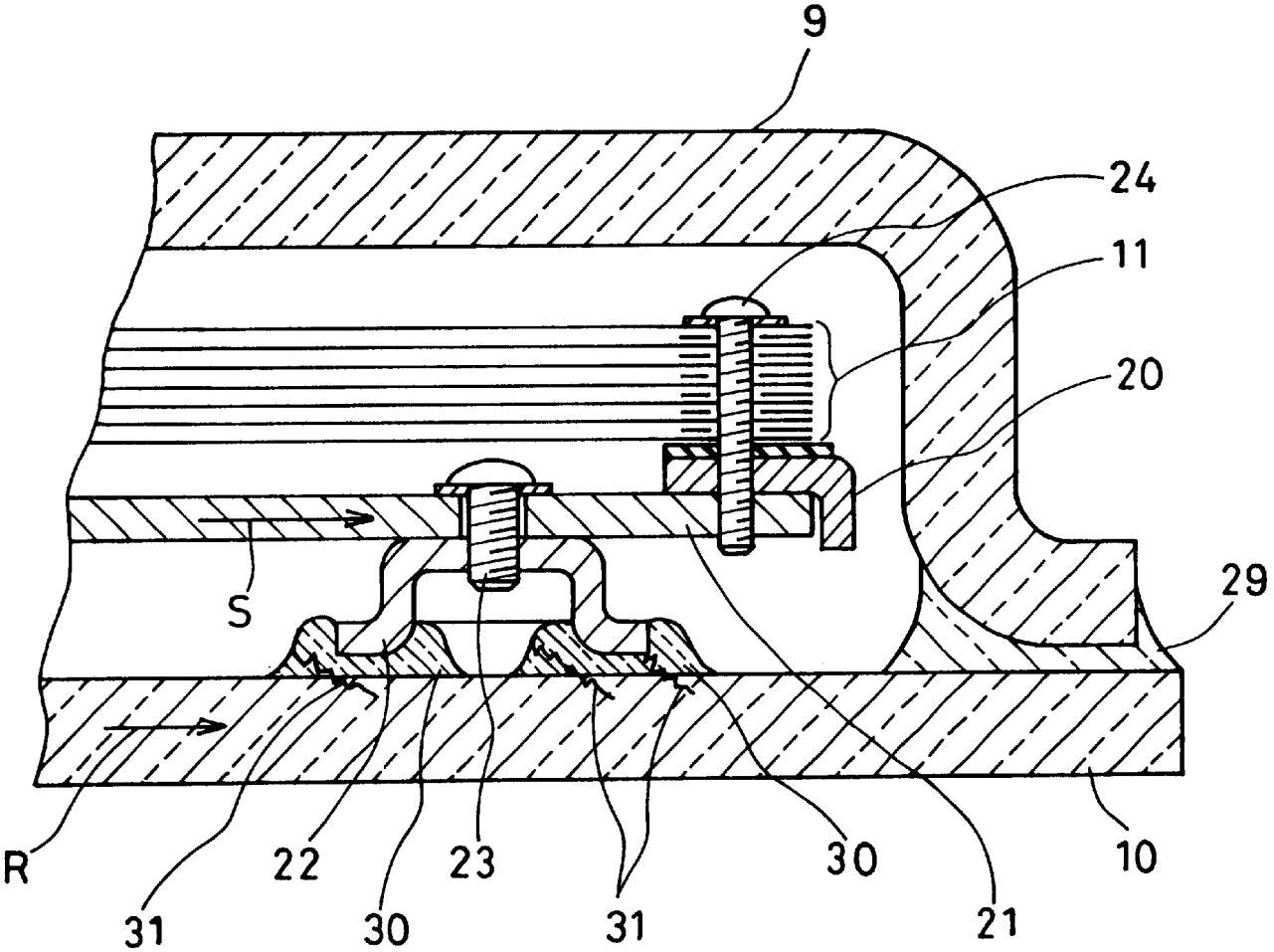
FIG. 10 is a partially enlarged cross-sectional view schematically showing a schematic electrode-unit mounting structure in which electrode support plates and electrode fixing plates that are assembled in parallel-crosses form are fixed to fixing stands in the flat-type image display apparatus in FIG. 9.

As shown in FIG. 8, outgoing terminals 19 leading to the outside from the periphery of the glass case are formed before sealing the glass case. The front case 9 and the rear case 10 of the glass case are sealed and fixed with low melting point glass at the same time while maintaining the tension of pulling the electrode unit 11 downward by the terminals 19, thus preventing the electrode unit from being deformed.

Figure 7:
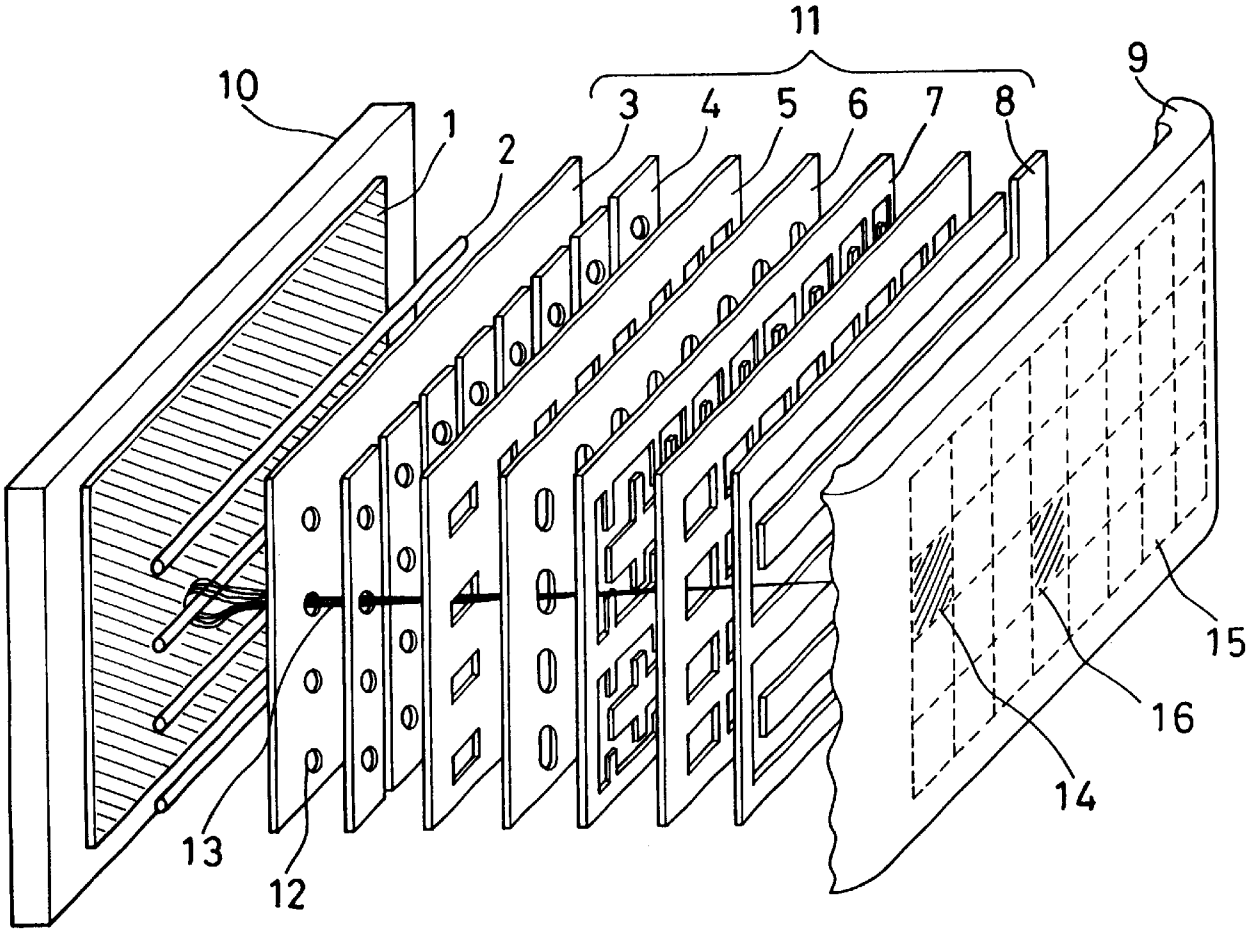
FIG. 7 is an exploded perspective view showing the internal structure of a flat-type image display apparatus.

Next, the electron-beam emission of the linear cathodes will be explained with reference to FIG. 1. The linear cathodes 2 are stretched in parallel to the back electrode plates 34 in the spaces between the screen-like back electrode plates 34 arranged in parallel. By applying a suitable voltage that is lower than that applied to an electron beam extracting electrode 3 (see FIG. 7) to the plates 34, a uniform space field is applied to respective linear cathodes. Therefore, an acute emission angle of the electron beams emitted from the linear cathodes 2 can be obtained, thus increasing the amount of electron beams passing through the electron beam extracting electrode 3 and thus improving luminance.

Figure 6:
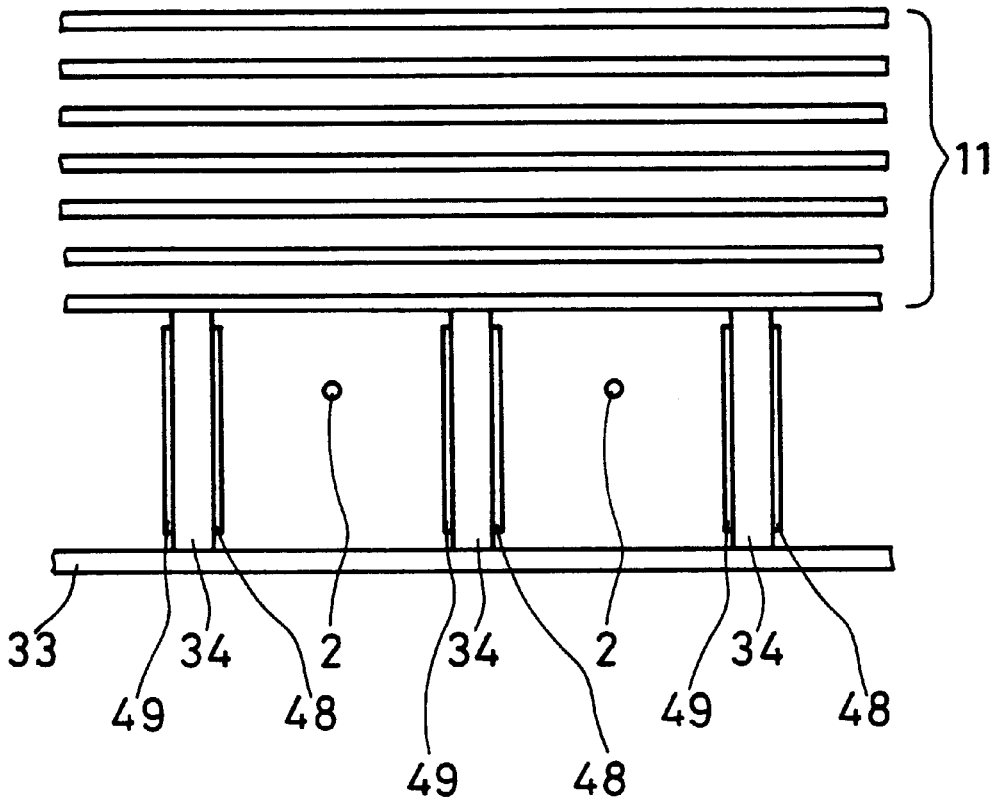
FIG. 6 is a schematic view showing the state where conductive films have been formed on side faces of back electrode plates.

As shown in FIG. 6, a conductive film (right) 48 and a conductive film (left) 49 are applied to respective left and right back electrode plates 34 sandwiching respective linear cathodes 2, respectively. By applying different voltages to the conductive film (right) 48 and the conductive film (left) 49, the variation in emission angle and in amount of electron beams emitted that are caused by the variation in accuracy of the back electrode plates 34 can be adjusted to be uniform.

Since back electrode plates 34 are placed at the left and right sides of all the linear cathodes 2, the electric fields around all the linear cathodes 2 become uniform and the amount of electron beams emitted also becomes uniform, thus eliminating the unevenness in luminance.

Furthermore, the linear cathodes 2 are surrounded by the back electrode plates 34, the back electrode substrate 33, and the electron beam extracting electrode 3. Therefore, electron leakage to the outside (especially in the vicinity of the case) does not occur, thus preventing high voltage discharge.

As shown in FIG. 1, getter 52 that absorbs gases in a vacuum is placed in the space between the rear case 10 and the back electrode substrate 33 provided with a flange-shaped bent portion at its periphery. Therefore, spattered getter is stopped at the bent portion of the substrate 33 and therefore does not adhere onto the linear cathodes 2 and the outgoing terminals, thus preventing bad insulation.

INDUSTRIAL APPLICABILITY

The present invention realizes a buffer effect for external impacts and thermal distortion in an inplane direction parallel to a screen and in a thickness direction by contriving the method of mounting a back electrode and an electrode unit. Consequently, accuracy, safety, and image quality of high performance in a flat-type image display apparatus were secured.

Thus, by making good use of such characteristics, the flat-type image display apparatus of the present invention can be widely applied as a flat-type image display apparatus used for a television receiver, a computer-terminal display unit, or the like.

What is claimed is:

1. A flat-type image display apparatus comprising, in a case formed of a front case and a rear case that is sealed with its inside being in a vacuum condition:

a flat-type screen to which phosphors have been applied;

a plurality of stretched linear cathodes;

an electrode unit including a plurality of sheet-like electrode plates; and a back electrode made of a conductive material;

wherein a plurality of fixing stands are attached to an inner face of the rear case, a back electrode substrate that functions as the back electrode is attached onto the fixing stands, the electrode unit is mounted on an upper face of the back electrode substrate, and only one fixing stand positioned substantially at a center of the back electrode substrate in the plurality of fixing stands is fixed to the back electrode substrate, and presser bar plate springs are attached onto the fixing stands except the fixing stand positioned substantially at the center of the back electrode substrate to fix the back electrode substrate by elasticity of the presser bar plate springs.

2. The flat-type image display apparatus according to claim 1, wherein the back electrode substrate is provided with slits at predetermined positions, the presser bar plate springs are inserted into the slits to bring lower faces of ends of the presser bar plate springs into contact with an upper face of the back electrode substrate, the presser bar plate springs and the fixing stands are fixed so that the presser bar plate springs press the upper face of the back electrode substrate downward.

3. The flat-type image display apparatus according to claim 1, wherein one or a plurality of bent pawls is formed at an end opposite to a pressing part of each presser bar plate spring to form one component with the presser bar plate spring and thus a function for preventing lift-off of the back electrode substrate is applied to the bent pawls.

4. The flat-type image display apparatus according to claim 1, wherein a plurality of back electrode plates are attached to the back electrode substrate in a screen-like manner.

5. The flat-type image display apparatus according to claim 1, wherein electrode fixing platforms are attached to the back electrode substrate at predetermined positions and the electrode unit is fixed to the electrode fixing platforms via insulators.

6. The flat-type image display apparatus according to claim 5, wherein the electrode unit is fastened and fixed to the electrode fixing platforms with screws.

7. The flat-type image display apparatus according to claim 5, wherein a plurality of back electrode plates are attached to the back electrode substrate in a screen-like manner and the back electrode plates and the electrode unit are brought into contact with each other via insulators.

8. The flat-type image display apparatus according to claim 7, wherein a height of upper faces of the insulators on upper faces of the electrode fixing platforms is lower than that of upper faces of the insulators on the back electrode plates.

9. The flat-type image display apparatus according to claim 7, wherein a central portion is higher than peripheral portions in each back electrode plate.

10. The flat-type image display apparatus according to claim 7, wherein pressure that is caused in sealing the case with its inside being in a vacuum condition and attempts to deform the rear case can be transmitted to the electrode unit through the fixing stands, the back electrode substrate and the back electrode plates.

11. The flat-type image display apparatus according to claim 5, wherein the electrode fixing platforms are attached to the back electrode substrate so as to be displaced elastically, one or a plurality of pawls is provided to each electrode fixing platform to form one component, and a function for preventing lift-off of the electrode unit is applied to the pawls.

12. The flat-type image display apparatus according to claim 4, wherein the plurality of back electrode plates are arranged substantially in parallel and in respective spaces between the back electrode plates, one or a plurality of linear cathodes are stretched substantially in parallel to the back electrode plates.

13. The flat-type image display apparatus according to claim 12, wherein the plurality of back electrode plates are made of a conductive material and a lower voltage than that applied to an electron beam extracting electrode in the electrode unit is applied to the plurality of back electrode plates.

14. The flat-type image display apparatus according to claim 12, wherein conductive members are applied onto both faces of each of the plurality of back electrode plates and different voltages are applied to opposed conductive members.

15. The flat-type image display apparatus according to claim 12, wherein the one or the plurality of linear cathodes is surrounded by the screen-like back electrode plates, the back electrode substrate, and the electrode unit.

16. The flat-type image display apparatus according to claim 1, wherein periphery of the back electrode substrate is bent toward the rear case in a flange shape, and in a space between the back electrode substrate and the rear case, getter that absorbs gasses in a vacuum is placed.

* * * * *